United States Patent [19]

Cozzens et al.

[11] Patent Number: 4,793,824

[45] Date of Patent: Dec. 27, 1988

[54] WEDGE SLOT CONNECTOR

[75] Inventors: Brian E. Cozzens, Mechanicsburg, Pa.; William R. Evans, Mooresville, N.C.; Wayne E. Kleiner, Mohrsville, Pa.

[73] Assignee: AMP Incorporated, Harrisburg, Pa.

[21] Appl. No.: 100,378

[22] Filed: Sep. 24, 1987

[51] Int. Cl.[4] ..... H01R 4/24

[52] U.S. Cl. ..... 439/395; 439/417

[58] Field of Search ..... 439/389–419, 439/425, 426, 428–432

[56] References Cited

U.S. PATENT DOCUMENTS

| | | | |
|---|---|---|---|
| 3,380,013 | 4/1968 | Krone et al. | 439/400 |
| 3,877,773 | 4/1975 | Doty et al. | 339/97 P |
| 3,897,993 | 8/1975 | Fleischhacker et al. | 339/99 R |
| 4,186,984 | 2/1980 | Reavis et al. | 339/103 R |
| 4,220,390 | 9/1980 | Cobaugh et al. | 339/97 R |
| 4,508,411 | 4/1985 | Hughes et al. | 339/99 R |
| 4,526,434 | 2/1985 | Saligny | 439/392 |
| 4,637,675 | 1/1987 | Loose | 339/97 R |
| 4,705,340 | 11/1987 | Loose | 439/395 |

FOREIGN PATENT DOCUMENTS

| | | | |
|---|---|---|---|
| 0179579 | 4/1986 | European Pat. Off. | 439/392 |

OTHER PUBLICATIONS

Drawings-Appln. Ser. No. 922,836, filed 10/22/86, 5 sheets.

Drawings-Appln. Ser. No. 810,794, filed 12/19/85, 8 sheets.

Drawings-Appln. Ser. No. 113,946, filed 10/28/87, 4 sheets.

Drawings-Appln. Ser. No. 100,378, filed 9/24/87, 3 sheets.

Drawings-Appln Ser. No. 114,183, filed 10/28/87, 3 sheets.

*Primary Examiner*—David Pirlot

[57] ABSTRACT

An electrical connector (18) terminates a conductor wire (10) through a conductive terminal (72) having a slot (74) which operates with a plastic push button (50) fitted in a plastic housing (30), the plastic parts having surfaces and the terminal slot having an orientation to wedgingly drive and trap the conductive wire against unwanted displacement, all under manual pressure. The plastic parts include surfaces (26, 64) allowing a reverse displacement for wire removal. A multiple wire version including a common housing (90) is taught with multiple push buttons (50).

5 Claims, 3 Drawing Sheets

WEDGE SLOT CONNECTOR

This invention relates to an electrical connector for terminating conductive wires through the cooperation of a plastic push button and insulation displacement connector (IDC) concept.

BACKGROUND OF THE INVENTION

U.S. Pat. No. 4,645,285, issued in the name of B. E. Cozzens et al, Feb. 24, 1987, teaches a sealed insulation displacement connector which features an elastomeric sealing between an electrical conductor wire and an electrical terminal. The terminal is of the IDC type and the connector housing allows manual operation for termination by pressing a button like element to effect wire termination. The patent is particularly concerned with sealing of the electrical interconnection. Wire retention in such patent is essentially based upon the engagement of the wire with the IDC terminal, the elastomeric foam operating to a degree to aid in wire support and retention.

The present invention relates to an improvement on the connector of the aforementioned patent, particularly in respect to conductor wire retention.

SUMMARY OF THE INVENTION

The present invention includes plastic and insulating parts, a housing having a recess therein into which is fitted a push button like plastic element made to have slots extended obliquely to the axis of insertion of the element within the housing so as to wedging drive a conductor wire into a slotted electrical terminal. The electrical terminal slot is oriented obliquely in an opposite sense so that as the button like element is driven within the housing to force the conductor wire in the terminal slot, the housing and terminal slots wedgingly trap the conductor wire to grip the insulation in a manner providing a strain relief and superior tensile characteristics. The plastic parts include in one embodiment surfaces allowing a reverse displacement to permit wire removal. The parts also include interior mating projections allowing the two parts to be positioned in an open or pretermination position prior to and during wire insertion and a second position following actuation of the button like plastic part. The invention concept is taught in a single wire termination version and in a multiple wire termination and connector version allowing multiple wires to be plugged into related circuit paths as for example into receptacles in a printed circuit board.

DETAILED DESCRIPTION OF THE INVENTION

Figure 1:
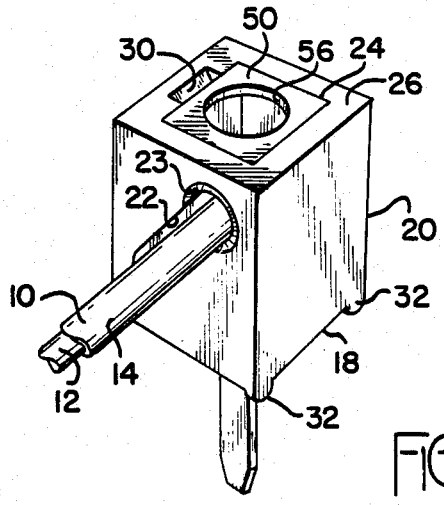
FIG. 1 is a perspective of the connector of the invention shown in an actuated condition terminating an electrical wire to an electrical terminal.

Referring now to FIG. 1, there is shown a conductor wire 10 comprised of a conductive core 12 typically of solid or stranded copper surrounded by an insulating covering 14 typically of polyvinyl chloride or polypropylene. Such wire is widely used for interconnecting electrical and electronic devices for signal, power and grounding purposes. Wire of this type comes in a wide variety of gauges with typical signaling applications employing wires in the 20 to 30 AWG sizes. In general, stranded versions of the wire are used where flexibility, bending, sharp radiuses and vibration are to be accommodated with solid wire being used in the more fixed or permanent placement of wire.

Also depicted in FIG. 1 is the connector of the invention shown as element 18 to be comprised of a housing 20 typically molded of plastic having insulating and dielectric properties. A wide variety of engineering plastics such as those comprised of nylon are satisfactory materials for such purposes. The connector 18 includes a housing 20 having in the version shown in FIGS. 1–4 an aperture 22 in the front thereof, which aperture is as shown disposed diagonally relative to the height of housing 20 and made to include beveled surfaces shown as 23 which aid in guiding the insertion of a wire 10. Within the housing 20 is a recess shown as 24 in FIGS. 1 through 4 which extends through the housing except for thin closed wall floor shown as element 28 in FIGS. 3 and 4. There is in the top surface 26 of the housing 20 as shown in FIGS. 1–4 a beveled surface 30 which, in a manner to be described hereinafter, allows for the insertion of a tool such as the end of a screwdriver to be utilized to remove the connector wedge insert and therefor wire 10 from the assembly. In the several drawing figures shown projecting from the bottom of the housing 20 are a series of projections 32 which serve as a standoff between the housing and any surface such as a printed circuit board upon which the connector is mounted. These projections permit removal of fluxes or other substances which could otherwise be trapped beneath the connector housing.

Figure 2:
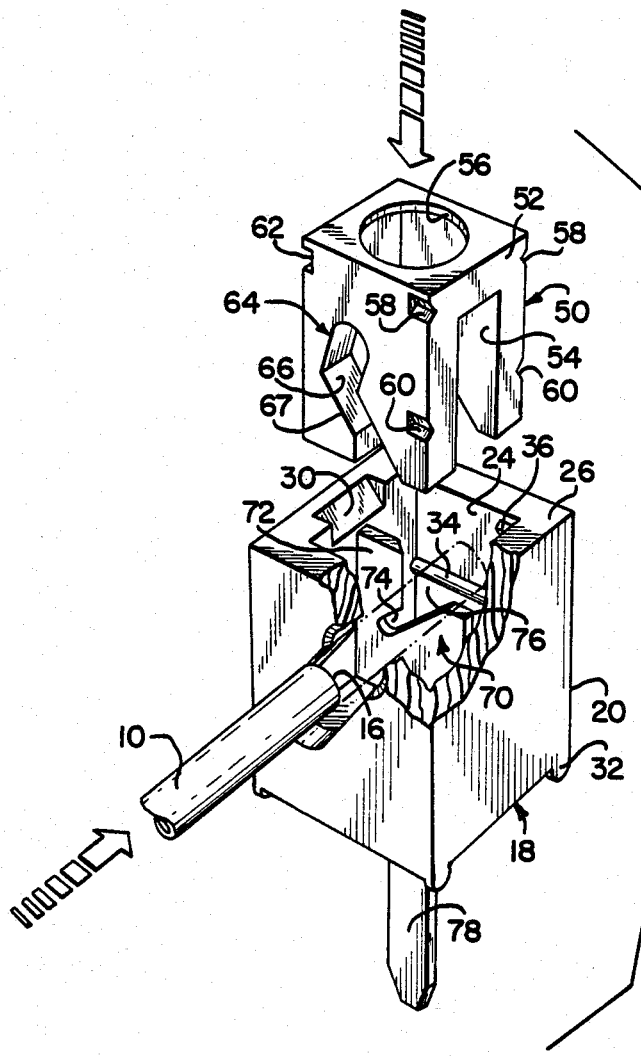
FIG. 2 is a view of the connector shown in FIG. 1 with the plastic parts thereof separated and in a condition prior to wire insertion with portions of part of the housing cut away to reveal the connector terminal.
Figure 3:
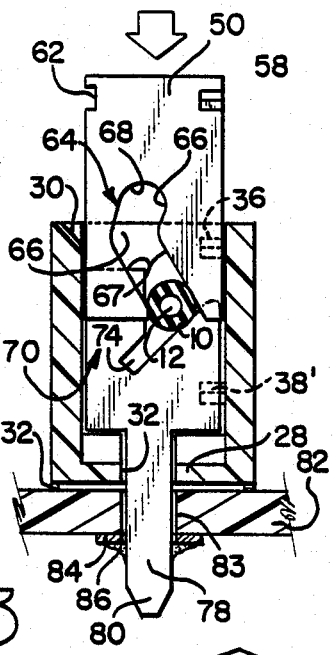
FIG. 3 is an elevation in partial section showing the connector of the invention in an open or pre-actuated condition following wire insertion and further showing the connector mounted to a printed circuit board, also shown in section.
Figure 4:
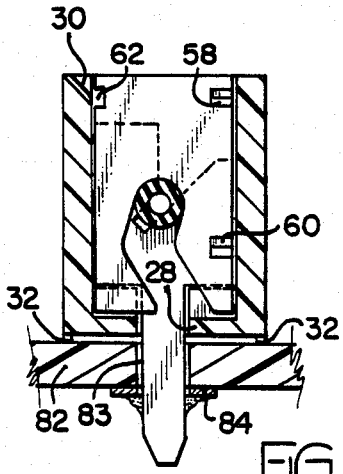
FIG. 4 is an elevation in partial section of the connector of FIG. 3 following actuation or closure for termination of the connector terminal to the conductor wire.

Within recess 24 as shown in FIG. 2 and as shown in FIGS. 3 and 4 are projections 36 near the top of housing 20 and a series of further projections 38 as shown in FIG. 4 extended well down within recess 24. These projections cooperate with recessed areas on the wedge insert to permit the insert to be maintained in an opened or closed position in a manner to be hereinafter described.

The wedge insert is shown best in FIG. 2 as element 50 including a U-shaped body 52 having a pair of legs forming the U, shown as 54 carrying externally recesses shown as 58 and 60 which cooperate with the projections heretofore described as 36 and 38 interiorly of housing 20. The top of the wedge insert includes an aperture shown as 56 which facilitates inspection of the interior of the connector, allowing an operator to make certain that the wire 10 is properly seated therewithin relative to the electrical terminal. Extending along one side of the top of wedge insert 50 is a groove shown as 62 into which may be inserted a tool such as the end of a screwdriver to pry the insert upwardly against the surface 30 in housing 20 as heretofore mentioned. This groove can be seen in FIGS. 2, 3 and 4, its position in assisting removal of the wedge insert being best revealed in FIG. 4.

Extending along the body of each of the U leg portions 54 of the wedge insert are slots shown as 64 which are oriented at an angle as best shown in FIGS. 3 and 4 which serve to provide a wedging action relative to the wire 10. The slots 64 include edge surfaces shown as 66 which are beveled as at 67 to assist in the insertion of a wire 10, guiding such wire through the interior of the housing 20. Such wire insertion can be seen best in FIG. 2 in phantom, the wire extending through the U leg 54 overlying the electrical terminal shown as 72 to be stopped against the interior rear face of housing 20. A surface shown as 34 supports the end of the wire 10 in against such rear wall against the forces of the wedge insert as is pushed within the recess.

The slot surfaces 66 are disposed along an axis approximately 30 to 40 degrees to the vertical axis of insertion of the wedge insert 50 interiorly of housing 20. The slots open into a more vertically disposed position shown as 68 at their upper ends.

Interiorly of the housing 20 is an electrical terminal 70 containing a blade portion 72 having therein a slot 74 extending at an angle. This angle is preferably on the order of between 30 to 40 degrees to the vertical axis of insertion. The slot 74 opens as at 76 to provide a V-shaped or funnel entry guiding the wire 10 toward the narrowed portion 74 of the slot. Terminal 70 includes further a projection 78 which extends vertically downwardly and is adapted in the embodiment shown in FIGS. 1 through 4 to be soldered to a printed circuit board. The end of the terminal portion 78 is beveled as at 80 to facilitate insertion within the aperture of a printed circuit board shown as 82 in FIGS. 3 and 4, the aperture being shown as 83. Printed circuit board 82 includes a conductive trace or layer of copper 84 and in FIGS. 3 and 4 there is solder shown as 86 joining such trace to the element portion 78 of the terminal. In accordance with the invention, the terminal 70 is stamped and formed from a conductive sheet metal having spring properties suitable for IDC use such as a hardened brass, phosbronze or beryllium copper suitably plated to facilitate soldering for the uses shown in FIGS. 2 and 4 or alternatively, being given a finish suitable for mating engagement with other spring terminals of a connector system. As a general rule, the slot 72 is given a width between 40 and 80 percent of the diameter of the wire of conductor 12 of wire 10. This range is adapted to the type of wire, solid or stranded and to a range of wire conductors for which the terminal is adaptable, typically several gauges. For example, a solid conductor in the 20 AWG size having a diameter of 0.0232 inches could have an optimum slot dimension on the order of between 0.016 and 0.02 inches in width. The slot 72 should have a length roughly one and half times the diameter of the largest wire intended to be used with the terminal. The funnel entry portion 74 is intended to not only guide the wire as it is being stripped when displaced along the slot, but to permit easy entry of the wire as insulated into the interior of the connector. In general, the terminal funnel entry portion 74 may be in the range of between 100 degrees and 60 degrees relative to the axis of the slot 72.

Referring now to operation of the connector of the invention, it is contemplated that the connector will typically be applied to a printed circuit board or other circuit and soldered or otherwise mechanically and electrically joined thereto prior to field use. For example, relative to a given electronic circuit package, a suitable number of connectors 18 would be fitted to a portion of the device and soldered thereto prior to shipment of the device to a customer. At that time the connectors 18 would have the inserts 50 in the open or upward position as shown in FIG. 3 being held by the engagement of the projections 36 in the recesses 60 of the wedge insert. In this upward position, the slots within the wedge shown as 64 would be positioned to allow the entry or insertion of the wire 10 in the manner indicated in FIG. 2. In accordance with a typical use of the invention, the device served thereby would be shipped to a premise location with wire being positioned appropriately in such premise and eventually being inserted into a connector 18 and terminated thereby to interconnect the electronic device on site. This is achieved by a downward push upon the wedge insert 50 which generates a force applied to the surfaces 66 of the slots 64 therein which displace the wire obliquely and downwardly, driving it into the slot 74 of the terminal 70 to terminate the conductive portion thereof which is stripped by the terminal surfaces as the wire is forced and deformed into slot 74. It can be observed from FIG. 2 and finally in FIG. 4 that the path of the wire is downward and to the left relative to the orientation of the connector shown therein. The axis of the slot extends obliquely and downwardly to the left whereas the axis of the slot of the wire of the insert 50 extends obliquely and downwardly to the right or in an opposite sense to that of the slot of the terminal. The resulting reaction is to position the wire within the terminal in a way so that it is wedged or trapped by the wedge element in the slot of the terminal. In this position of wire, wedge and housing, the wire is supported by the surfaces 66 of each wedge slot 64 on both sides, the slots 64 being present in both legs of the U 54. In the downward or closed position, the projections 36 become seated in the recesses 58 of the wedge, further providing a frictional holding of the wedge within the housing recess. As can be discerned from FIG. 4, pressure upon the wedge leads to a downward displacement until the leading edge of the wedge strikes the bottom or interior 28 of the housing 20.

In most instances and particularly in premise wiring or on-site wiring, the termination effected by the invention connector will be permanent and not removed. If in the event, however, removal is necessary, a screwdriver placed within the groove 62 of the wedge via the beveled surface 30 as shown in FIG. 4 may be used to pry the wedge upwardly and remove it from the housing to a point allowing withdrawal of the conductor wire. Thereafter, a fresh wire may be inserted within the connector and terminated, the use of tin plated wire being preferred in the event of reuse of the connector.

Figure 5:
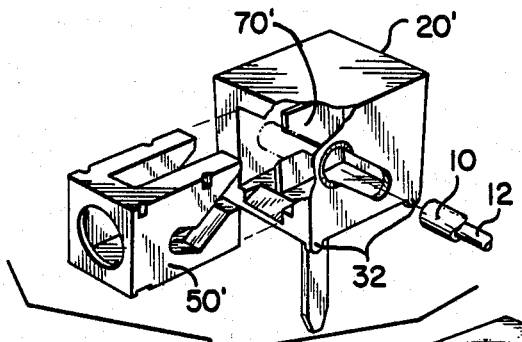
FIG. 5 is a perspective view of an alternative version of the connector of the invention featuring a side mount construction with the various elements separated to reveal details.
Figure 6:
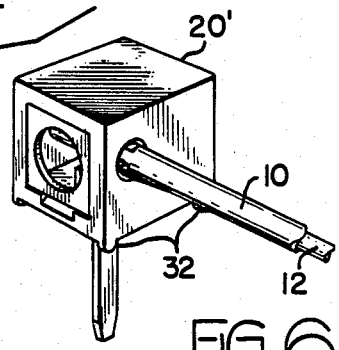
FIG. 6 is a perspective of the connector as shown in FIG. 5, assembled and actuated.

Referring now to FIG. 5 and to FIG. 6, alternative versions of the connector of the invention are shown to have common components shown as 20' and 50' with the terminal being shown as 70', the essential differences being related to the orientation of the axis of insertion of the wedge insert relative to the housing and the terminal. With respect to the alternative embodiment shown in FIGS. 5 and 6, wire 10 is inserted as in the prior embodiment with the wedge insert 50' being forced inwardly to terminate the wire within terminal 70'. The embodiment shown in FIGS. 5 and 6 may be optionally used and preferably employed in those instances where it is unwise or impractical to have the force of insertion applied to the printed circuit board or other circuit of use as is the case with respect to the embodiments of FIGS. 1 through 4. The force applied to the insert 50' will, in the case of the embodiments of FIGS. 5 and 6, be made to extend parallel to such board or circuit and be applied between the surface of the wedge insert 50 and the opposite face of housing 20.

As a general rule and particularly with respect to wires on the order of 20 AWG to 28 AWG, the forces required to effect displacement of the wedge insert 50 within the housing 20 are relatively low, being on the order of 10 to 20 pounds including frictional forces for the wedge features of the connector. In the larger wire sizes, such forces may exceed 20 pounds in which event a tool may be employed to force the wedge within the housing of the connector, care being taken to avoid damage to the printed circuit or other circuit of use.

Figure 7:
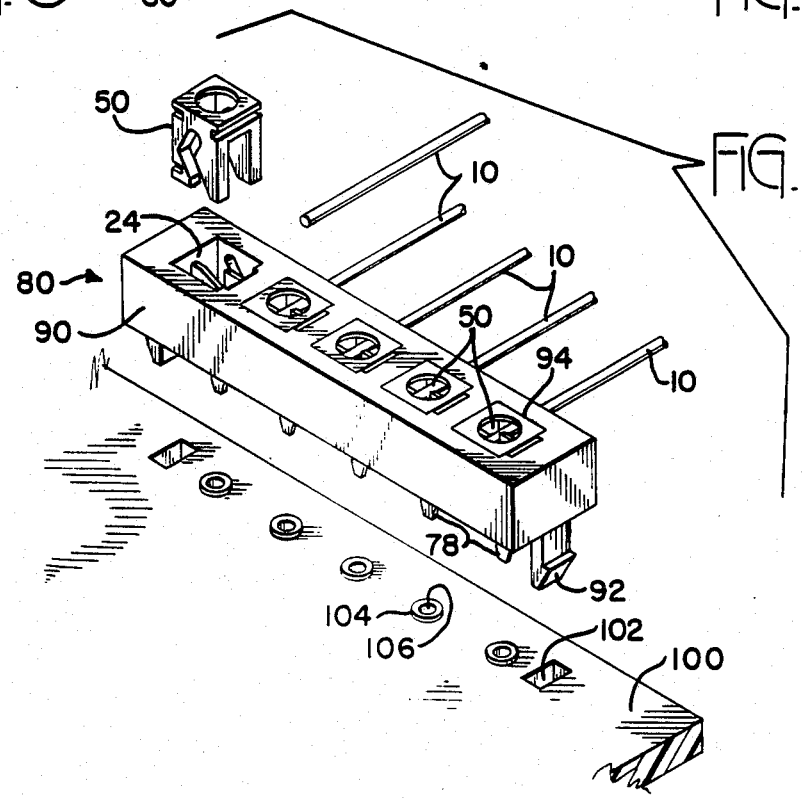
FIG. 7 is a perspective of the connector of the invention i a multi wire form poised for engagement in complementary electrical terminals in an electrical circuit such as a printed board.

Referring now to FIG. 7, a connectorized version of the invention is shown wherein multiple wires 10, five being shown in FIG. 7, are terminated through a connector 80. The connector 80 is made to include a series of five wedge inserts 50 and appropriate recesses 24, terminal 70, and so forth. The connector 80 has a housing 90 which is common to all of the inserts but includes additionally projections shown as 92 which serve to polarize and latch the connector to a further circuit component. This circuit component is shown in FIG. 7 in an embodiment numbered 100 representing the printed circuit board of an electronic device. The printed circuit board 100 includes slots shown as 102 which cooperate with the projections or latches 92 on the housing of the connector 80. Additionally shown in FIG. 7 are a series of contacts shown as elements 104 which contain springs 106 adapted to receive the projection terminal portions 78 of each of the five wire terminals shown in FIG. 7. The connector 80 may be plugged into the board 100 with the terminals 78 extending into and contacting in spring engagement spring elements 106 of contacts 104. It may be taken that these contacts are joined to circuit paths on board 100 as by soldering or other suitable method.. The connector 80 may be plugged into or withdrawn from the board and may be terminated in the field at premise or on site essentially without a tool, the wedge inserts being manually depressed by an operator or installer in the manner heretofore described.

In practice and in use in the field, a suitable wire may be inserted within the connector of the invention, the wedge insert driven along the recess of the connector housing to be seated therewithin, the parts being dimensioned to provide a flush fit and thus visual indicating of seating. Thereafter, observation may be had through the aperture 56 in the wedge insert of the wire as terminated or alternatively in the event of improper insertion, visualized to have been improperly inserted. In the event that the termination being made is deemed to be satisfactory and checked out with no further changes contemplated, the inspection port or aperture 56 may be employed to inject an elastomeric sealer such as any of the electrical silicone rubbers now being used for such purpose which not only seals the interior of the connection against airborne contaminants, but upon hardening, locks the terminal and wire interior of the connector together against removal of the wedge. The filling of the insert further provides a visual indication of a termination achieved and checked.

It is contemplated that the invention is shown in FIGS. 1 through 4 will be quite adequate as an electrical termination in most applications, the latter use of a sealer or elastomeric material being employed in only the more rigorous uses of the invention, those exposed to moisture or particularly damaging airborne contaminants.

Having now described the invention in terms intended to enable a preferred practice thereof, we define its scope through the appended claims.

We claim:

1. An electrical interconnection device comprising;

an insulating housing having a first part including a plurality of recesses, and a plurality of second parts shaped to be slidingly pressed into and axially along corresponding said recesses, apertures in said first and second parts, means on the surfaces of said first and second parts to latch said first and second parts together in corresponding first positions to receive conductor wires inserted through said apertures, and to latch said first and second parts together in corresponding second positions with said second parts pressed into said first part through said recesses, said second parts including corresponding slits therein oriented obliquely of corresponding recesses to force corresponding conductor wires to travel obliquely of corresponding recesses, electrical terminals mounted in said first part and extending along corresponding recesses, said terminals including corresponding wire receiving slots oriented obliquely of corresponding recesses and extending across corresponding slits, whereby to wedge corresponding wires in said slots and in said slits to trap said wires.

2. The device of claim 1 including an aperture in said second part to allow inspection of said wire as wedged in said terminal.

3. The device of claim 1 including surfaces on said first and second parts adapted to be cooperatively engaged by a tool to extract a corresponding second part from said first part and thereby remove a corresponding wire from a corresponding terminal.

4. The device of claim 1 wherein, each of said terminals includes a projecting portion adapted to be plugged into a further interconnection device, and further including a further interconnection device having contact elements aligned with the projecting portions of said terminals.

5. The device of claim 4 wherein each of said second parts includes in the upper surface thereof an aperture to allow inspection of a corresponding connection of a terminal and a wire.

* * * * *